United States Patent [19]

Fiske

[11] Patent Number: 4,988,029

[45] Date of Patent: Jan. 29, 1991

[54] FINISHER ACCESSORY FOR HARD COPY PRINTERS

[75] Inventor: John M. Fiske, Medford, Mass.

[73] Assignee: Eastman Kodak Company, Rochester, N.Y.

[21] Appl. No.: 296,103

[22] Filed: Jan. 12, 1989

[51] Int. Cl.[5] ..... B27F 7/19

[52] U.S. Cl. ..... 227/5; 227/39; 227/78; 227/99

[58] Field of Search ..... 227/3, 5, 78, 39, 99, 227/100, 102; 270/53; 412/33

[56] References Cited

U.S. PATENT DOCUMENTS

| | | | |
|---|---|---|---|
| 3,554,531 | 1/1971 | Heigl et al. | 270/53 |
| 3,698,616 | 10/1972 | Erhardt, Jr. | 227/99 |
| 4,134,672 | 1/1979 | Burlew et al. | 227/78 X |
| 4,238,066 | 12/1980 | Brooke | 227/39 |
| 4,248,413 | 2/1981 | Fox | 170/53 |
| 4,372,473 | 2/1983 | Holdsworth | 227/3 |
| 4,424,963 | 1/1984 | Bartholet et al. | 270/53 |
| 4,516,714 | 5/1985 | Braun et al. | 227/78 |
| 4,533,132 | 8/1985 | Wangermann | 270/53 |
| 4,586,640 | 5/1986 | Smith | 227/14 |
| 4,592,651 | 6/1986 | Oikawa et al. | 355/72 |
| 4,595,187 | 6/1986 | Bober | 270/53 X |
| 4,626,156 | 12/1986 | Baughman et al. | 412/33 |
| 4,640,611 | 2/1987 | Ohdake et al. | 355/77 |

FOREIGN PATENT DOCUMENTS

| | | |
|---|---|---|
| 0266739 | 5/1988 | European Pat. Off. . |
| 0302519 | 2/1989 | European Pat. Off. . |
| 2061886 | 5/1981 | United Kingdom . |

*Primary Examiner*—Paul A. Bell

*Attorney, Agent, or Firm*—Lawrence P. Kessler

[57] ABSTRACT

A finisher for stacking and stapling, or binding, sheets of paper from printers and the like. The finisher accommodates two sizes of paper, one frequently being twice the size of the other. Staples are positioned in the smaller size papper along an edge and in the larger size in the middle of the sheets. Two fixed position gates are controlled to stop the paper sheets at one of two positions for alignment and stapling. Once stapled, the sheet sets are gripped, turned over, and deposited on elevator-type stacking trays. For the shorter sheet sets, the trays move independntly. For the larger sheet sets, the trays move togehter.

27 Claims, 2 Drawing Sheets

FINISHER ACCESSORY FOR HARD COPY PRINTERS

BACKGROUND OF THE INVENTION

1. Field of the Invention

This invention relates, in general, to finisher accessories for printers and duplicators and, more specifically, to apparatus for stapling together sets of sheets from hard copy producing apparatus.

2. Description of the Prior Art

Finishers are used in conjunction with copiers, printers, duplicators, and similar hard copy apparatus which produce hard copy outputs, such as sheets of paper, for the purpose of performing an extra function or operation on the sheets. One such operation is securing the sheets together in a known arrangement, such as in booklet form with binding at the center, or bound together at the edges of the sheets. With either binding system, the binding method can be by staples, stitching through the paper, or other suitable means.

Traditional finishers are usually constructed to operate with a particular type of hard copy producing apparatus, such as printers. Normally, these prior art finishers are capable of handling only limited sizes of paper and binding the sheets together at only one general position. The complexity of these finishers is such that it is not feasible to modify the apparatus to handle different paper sizes and different binding locations. The size of the finishing units is an important factor in limiting the amount of extra equipment which can be included in the finisher to make it more versatile. Many printers and other hard copy output apparatus produce sheets of different lengths and with different binding requirements. Traditional finishers cannot be used efficiently with printers having such capabilities and even interchanging finishers with the same printer is time consuming and not an ideal solution to the problem of finishing papers from versatile printers.

Several U.S. patents have disclosed finishing apparatus which is used to perform operations on sheets of paper. These patents are of some relevance here because of their general similarities. However, none of these patents disclose or suggest finisher apparatus constructed the same as the finisher disclosed herein.

U.S. Pat. No. 4,586,640, issued on May 6, 1986, discloses a finishing system which staples sheets of the same size together. U.S. Pat. No. 4,372,473, issued on Feb. 8, 1983, discloses apparatus for stitching together sheets of paper of varying sizes. Differences in size are accommodated by moving the stitching machines or stations within the apparatus. U.S. Pat. No. 4,533,132, issued on Aug. 6, 1985, discloses apparatus for stitching together sheets of paper after the sheets are folded, with the structure of the apparatus being very unlike the structure of the present invention. U.S. Pat. No. 4,424,963, issued on Jan. 10, 1984, discloses a finisher for stapling together sheets from a copier or duplicator. The sheets are only stapled along an edge of the sheets. U.S. Pat. No. 4,626,156, issued on Dec. 2, 1986 to the same assignee as the present invention, discloses finishing apparatus for stapling together sheets of paper with additional sheets to make booklet covers. None of these patents disclose or teach apparatus similar to the present invention.

Since the same printer is now often capable of providing various size sheets at the command of the operator, such as either $8\frac{1}{2}\times11''$ or $11\times17''$, a versatile finisher accessory which can readily accommodate various sizes is advantageous. Even when operated with different printers having different paper size outputs, the convenience of having one finisher capable of handling the outputs of various printers in a compact package is important. Therefore, it is desirable, and it is an object of this invention, to provide a compact finisher accessory for printers and other hard copy producing apparatus which can handle the different paper sizes and stapling locations usually associated with these Printers while maintaining high productivity. The finisher is particularly useful when the printer output is face down in page-order sequence, first page first.

SUMMARY OF THE INVENTION

There is disclosed herein new and useful apparatus for stacking and stapling, or otherwise binding together, stacks of sheets from printers, copiers, and duplicators. The apparatus includes two controllable gates or stops which are located at fixed positions within the finisher. The gates are controllable to stop the edges of sheets fed into the finisher such that the stacks or sets of sheets accumulated in the stapling station of the finisher are aligned and located at the proper position for stapling. The finisher is capable of handling two different sizes of sheets, with the larger size frequently being twice the size of the smaller sheet. In the case of stapling the smaller size sheets, the gate closest to the stapling station is controlled or activated to stop the edges of the sheets which enter the finisher so as to accumulate sheets to form a stack set with the leading edge of the sheets only slightly displaced from the effective center of the stapling station. The displacement is dependent upon the desired location of the staple from the edge of the sheet, usually between $1/16''$ and $\frac{7}{8}''$ for the shorter sheets. When longer sheets are being accommodated, the gate closer to the stapling station is raised and the gate farther from the stapling station is lowered into a position to stop the edges of the sheets. This locates the sheets in the stack with the center of the sheets directly under the effective center of the stapling station. Thus, staples are located in the sheet sets at the exact center of the sheets so that folding of the sheets can be conveniently accomplished to form booklets.

With either short or long sheets, once the stapling operation takes place, the appropriate gate is raised to allow the stapled sheet set to move into engagement with a gripper which pulls the stapled sheet set around and under the stapling and gate assembly for deposition of the stapled sheet set upon an elevator-type stacking system. The stacking system includes two similar elevator systems positioned adjacent to each other, with each elevator system dimensioned similarly and suitably for accepting stapled sheet sets of the smaller size. The gripper holding the sheets sets is suitably released to deposit sheet sets first upon one elevator system, and after that system is full, upon the other elevator system. Stacking continues to alternate between the two elevator systems after each system becomes full so that they may be independently removed from the finisher without requiring that the finisher be stopped temporarily. Thus, when the smaller sheet sets are being processed, the two elevator stacking systems move independently of each other and each system contains stacks of completed and stapled sheet sets. On the other hand, when the long paper is being used for center stapled sheet sets, the elevator systems move simultaneously together side-by-side to effectively provide one elevated platform for supporting the larger sheet sets. Because of the dimensional correspondence between the two stacking systems and the larger sheet sets, both systems can be moved together to provide sufficient support and area for stacking the larger finished stack sets. The finisher thus provides, in one compact package, means for stacking and stapling at convenient and customary locations stack sets consisting of sheets of two different standard sizes which have a fixed dimensional relationship to each other.

BRIEF DESCRIPTION OF THE DRAWINGS

Further advantages and uses of this invention will become more apparent when considered in view of the following detailed description and drawings, in which.

DESCRIPTION OF THE PREFERRED EMBODIMENTS

Figure 2:
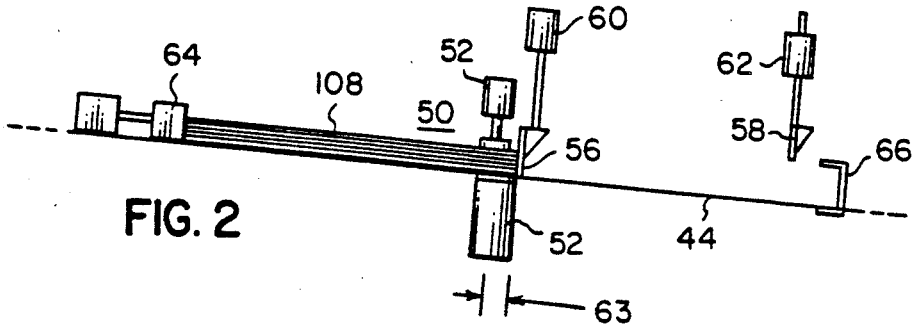
FIG. 2 is a schematic view of the stapling area of the finisher shown in FIG. 1 illustrating its operation with short paper.

Throughout the following description, similar reference characters refer to similar elements or members in all of the figures of the drawing.

Figure 1:
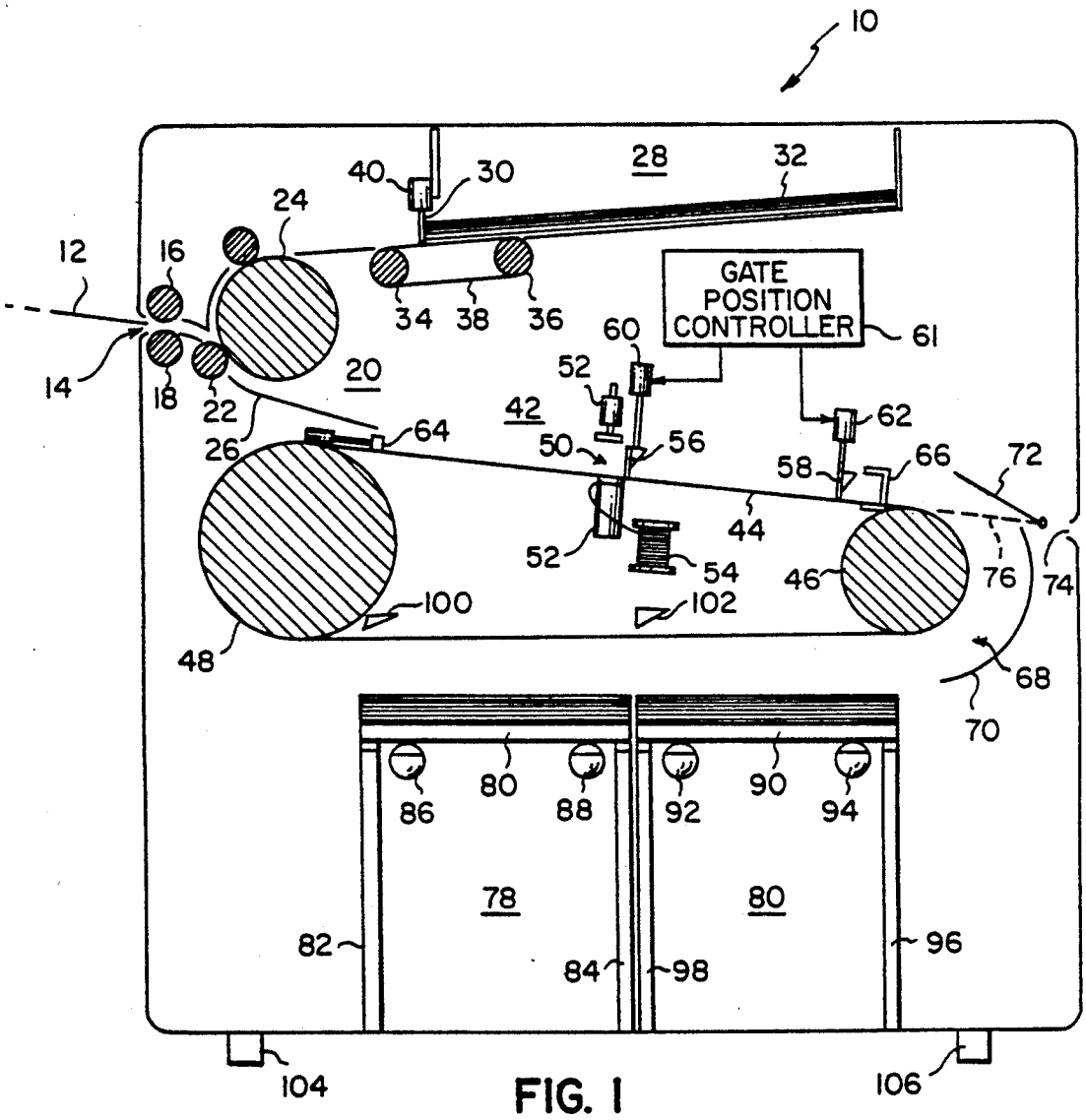
FIG. 1 is a schematic elevational view of a finisher constructed according to this invention.

Referring now to the drawing, and to FIG. 1 in particular, there is shown a finisher accessory 10 constructed according to this invention. The finisher would normally be positioned at the output end of a printer or copier where the sheets from the printer or copier would be fed directly into the finisher automatically. Sheet 12 represents such a sheet and is positioned to enter the opening 14 in the finisher 10. The sheet feed and guide assembly 20 includes the rotating rollers 16, 18, 22 and 24 which move the paper sheet 12 into the finisher and across the guide member 26. The dispenser 28 provides a means for selectively feeding separate sheets along with the sheets entering the finisher 10 from the associated printer. The separate sheets may be for the purpose of making booklet covers for the sheets bound and attached by the finisher, special sheets desired within the attached booklet or stack of sheets, or any other predetermined sheets which are to be interleaved with the stack of sheets received from the printer. The dispenser 28 includes the controllable gate 30 which, when instructed, can be raised to permit one of the sheets to be pulled from the stack of sheets 32 by the lower transport and feed mechanism which includes the rollers 34 and 36 and the conveyor 38. When a sheet is to be fed from the dispenser 28, the gate 30 is raised by the solenoid 40, in this specific embodiment, to allow the exit of a sheet of paper from the dispenser 28. Other gate control mechanisms may be used within the contemplation of the invention.

When the sheets of paper pass down across guide member 26, they move onto the transport system 42 of the finisher which includes the conveyor, belt, or chain 44 and the rotatable rollers 46 and 48. A stapling station 50 is used to staple together a plurality of the sheets after they have been stacked and aligned in the transport system 42. In this specific embodiment, the stapling station 50 includes the anvil 51, the wire stapler 52, and the wire supply roll 54. When a stapling operation takes place, the anvil 51 is moved down on top of the paper stack at the same time the staple is ejected from the stapler 52. It is also within the contemplation of the invention that other binding or attaching methods may be used, such as stitching the sheets of paper together at the stapling station position.

Controllable gates 56 and 58 are used to determine the position at which the paper sheets entering the finisher 10 will be aligned for accurate location of the staple, or staples, in the stack of paper sheets. As will be described in more detail in conjunction with the other figures of the drawing, gates 56 and 58 are either raised or lowered by appropriate means, such as by the solenoids 60 and 62, respectively, to accommodate the various paper sizes and stapling positions the finisher is constructed to accommodate. In this embodiment, the solenoids are controlled by the gate position controller 61. The jogger 64 is used to move or jog the stack of paper sheets into exact alignment with the appropriate gate, thereby aligning the edges of all the sheets before the stapling operation takes place.

Additional components of the finisher 10 include the gripper 66 which is connected to the transport conveyor 44 for grabbing or gripping the stapled sheet sets and moving them through the flow path 68 which is partially defined by the guide member 70. When being pulled through the flow path 68, the sheet sets are turned upside down so that the top of the stacked set was originally the bottom sheet of the stacked set during the stapling operation. A feed through flap or diverter 72 is positioned near the opening 74 in the finisher such that, when it is desired, the diverter 72 can be lowered to the position 76 so that the sheet sets will be ejected from the finisher 10 through the opening 74 instead of being turned over and deposited on the stacking apparatus contained in the lower section of the finisher.

The lower section of the finisher includes a means for stacking the finished and stapled sheet sets which are brought through the flow path 68 by the gripper 66. The stacking system includes the elevator systems 78 and 80. The elevator systems 78 and 80 are similar but are controllable separately in that each system can be indexed, or moved vertically, independently of the other when desired. The elevator system 78 includes the tray or platform 80 and the elevator rails 82 and 84. The platform or tray 80 has wheels or casters 86 and 88 connected thereto to aid in transporting the finished sheet sets when the tray 80 is removed from the finisher 10. Elevator system 80 is similarly constructed and includes the tray or platform 90, the casters or wheels 92 and 94, and the elevator rails 96 and 98. Each of the elevator systems shown in FIG. 1 include a set of sheets which have been stapled and transported from the stapling area and deposited on the elevator systems. Depositing the stapled sheet sets on the elevator systems is accomplished, as will be described in more detail later, by the gripper releasers 100 and 102 which trip the gripper 66 at the appropriate position to drop the stapled sheet set onto the appropriate elevator system. The finisher accessory 10 also includes the wheels or casters 104 and 106 which aid in the mobility of the apparatus for movement between different printers.

FIG. 2 is a schematic view of a portion of the finisher shown in FIG. 1 illustrating the operation of the finisher when using the shorter of the two paper sizes for which the finisher is constructed to accommodate. It will be assumed that the shorter paper is of dimensions $8\frac{1}{2}\times 11''$, with the 11" dimension or length of the paper extending perpendicular to the plane of FIG. 2. Therefore, the $8\frac{1}{2}''$ dimension of the paper is positioned between the jogger 64 and the gate 56. These sheets are accumulated on the conveyor 44 by the finisher from the separate sheets fed from the associated printer and/or from the slip sheet dispenser 28 shown in FIG. 1. Once the desired number of sheets have been stacked, the stapling station 50 is activated to staple the separate sheets along the edges of the sheets to form a bound and stapled sheet set 108.

The gate 56 is controlled, as shown in FIG. 2, to be in a position for stopping the flow of sheets through the finisher at a position where the edges align in the stapling station 50 for proper placement of the staples along the edge of the sheet set 108. Thus, gate 56 is in a downward position directly in the flow path of the sheets. Gate 58 is in an upward position so that when the sheet set 108 exits the stapling station 50, it will not impede its flow to the gripper 66, such flow being provided by the conveyor 44 and/or an independent conveyor, not shown, which can move the sheet set 108 without movement of the gripper 66. In the configuration shown in FIG. 2 for short sheet sets, the spacing between the jogger 64 and the gate 56 is substantially equal to the width of the shorter paper, or $8\frac{1}{2}''$ in the example given. Since it is usually desirable to locate the staples or other securing member inside of the edge of the paper a slight distance, the stapling station 50 is located such that the staples are positioned in the paper a fraction of an inch from the sheet edges aligned along the gate 56. Normally, the staples are located between 1/16" and $\frac{7}{8}''$ from the sheet edge. This offset distance 63 is represented in FIG. 2.

Figure 3:
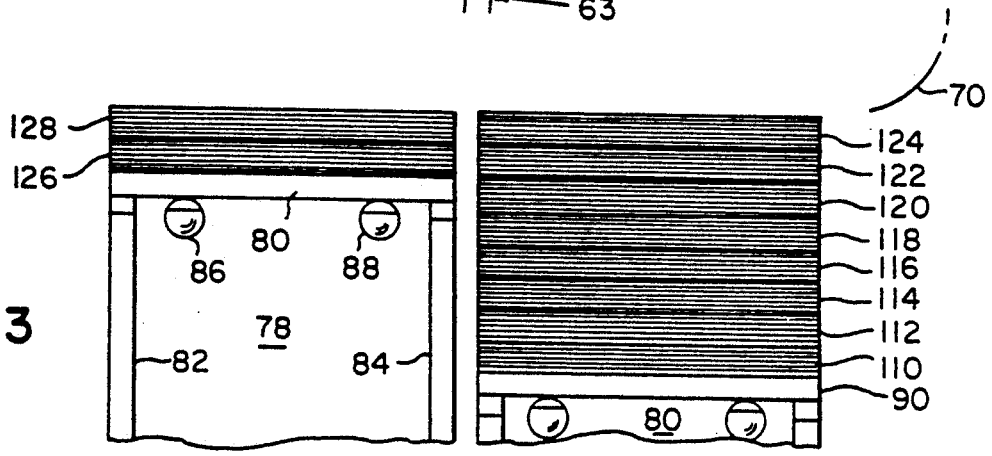
FIG. 3 is a schematic view of the stacking area of the finisher shown in FIG. 1 illustrating its operation with short paper.

FIG. 3 is a schematic view of the elevator assemblies used in the lower portion of the finisher accessory. FIG. 3 illustrates the operation of the elevator assemblies when used in connection with the shorter paper sheet sets which would be produced by the finisher when the gates are positioned during the stapling operation according to the locations shown in FIG. 2. According to FIG. 3, the sheet sets are stacked upon the elevator systems 78 and 80 separately in an effort to load one elevator system completely before the sheet sets are deposited or placed upon the other elevator system. In other words, the elevator system 80, shown in FIG. 3, has had the sheet sets 110, 112, 114, 116, 118, 120, 122 and 124 placed thereon prior to the placing of sheet sets 126 and 128 upon the elevator system 78. The reason for this is that it may be more practical in some applications to completely fill to the limit one elevator system tray, such as tray 90, so that it can be removed and transported for further processing while the second elevator system, system 78, is being stacked with the completed sheet sets. This permits greater throughput for the machine in that it can still be stapling and stacking sheet sets while some of the already stapled and stacked sheet sets are being removed from the finisher. Once the elevator system 78 becomes full, it is assumed that the elevator system 80 will be back in place without any sheet sets contained thereon so that the next sheet sets can be placed on tray 90 of elevator system 80.

One of the important points to emphasize in the arrangement of the elevator systems 78 and 80 shown in FIG. 3 is that each system is positioned adjacent to each other underneath the stapling and transport system of the finisher. Each system is dimensioned so that it accepts sheet sets individually of the smaller sheet size and that each elevator assembly is vertically movable independently so that sheet sets can be stacked upon one elevator assembly before being stacked upon the other assembly. Movement vertically can be accomplished by various prior art techniques. For example, a fixed counter of the number of sheets produced by the finisher to automatically index downward the assembly trays may be used. In addition, a photoelectric or light detecting source may be used to determine when the stacked sheets become too high and indexing downward is necessary. Using the weight of the sheet sets, or any other suitable means for moving the elevator assemblies so that the stack of sheets does not become too high, is within the contemplation of the invention.

Figure 4:
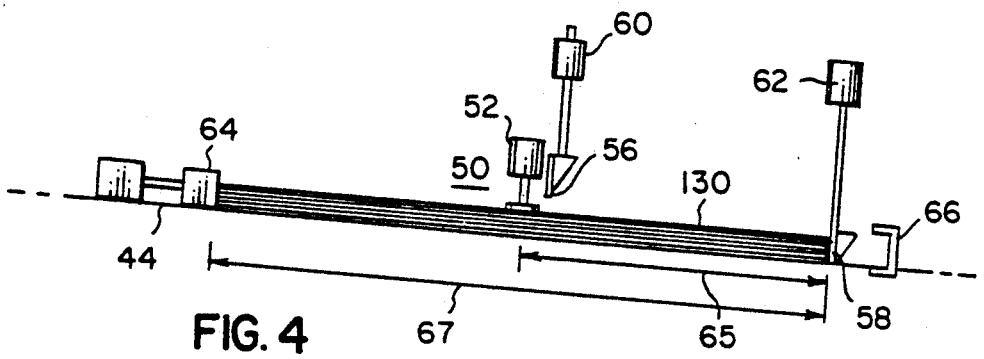
FIG. 4 is a schematic view of the stapling area of the finisher shown in FIG. 1 illustrating its operation with long paper.

FIG. 4 is a schematic view of the stapling area of the finisher shown in FIG. 1 illustrating the operation of the stapling portion of the finisher when used with the long sheets for which the finisher is constructed. The long sheets have twice the width dimension of the short sheets which the finisher can accommodate. In other words, if the short sheets are $8\frac{1}{2}\times 11''$, the long sheets would be $11\times 17''$, with the 17" dimension being located between the jogger 64 and the gate 58, and the 11" dimension extending perpendicular from the plane of FIG. 4. When using the long paper, the finisher arranges the components of the system so that the long paper can be accommodated and will be stacked into groups or sets of sheets at a location for proper stapling of the sheets.

According to FIG. 4, the gate 56 is controlled to be in the upward position when the long sheets are being used. In addition, the gate 58 is located in the lowered position so that the sheets bypass the gate 56 and are stopped by the gate 58. This dictates the alignment of the leading edges of the long sheets against the stop 58 rather than against the stop 56 as shown in FIG. 2 for short sheets. Gate 58 is positioned at a fixed location within the finisher apparatus such that the distance 65 between the gate 58 and the effective center of the stapling station 50 is $\frac{1}{2}$ the width 67 of the paper contained in the sheet set 130. With the example dimensions previously given, distance 65 would be $8\frac{1}{2}$. Similarly, the distance 67 between the effective surfaces of the jogger 64 and the gate 58 would be 17". Because of these fixed locations, the sheet set 130 is stapled in the middle thereof, which is usually the desired location and provides for folding the stapled sheet set, in a later operation, to make a centerbound booklet.

The fixed distance between the two gates 56 and 58 depends upon the width of the papers involved and the desired location of the staples from the edge of the shorter sheet sets. With the sheet sizes similar to those used in the examples, that is, $8\frac{1}{2}\times 11''$ and $11\times 17''$, the fixed distance between the gates 56 and 58 would be slightly less than $8\frac{1}{2}''$. Ordinarily, this would be approximately $8\frac{1}{4}''$, although any dimension between 8 1/16" and $8\frac{7}{8}''$ would be feasible. This range permits the staple in the edge of sheets sets of the shorter sheet sizes to be located between 1/16" and $\frac{7}{8}''$ from the edge of the sheets. The overall determining factor of the distance between the gates 56 and 58 is, of course, the basic size or width of the smaller sheets and the distance from the edge of those sheets that the staple is desired to be located.

According to FIG. 4, the sheet set 130 has been formed by accumulating separate sheets coming from the associated printer or the associated slip sheet dispenser. Once the required number of sheets have been accumulated under the stapling station 50 and against stop or gate 58, the jogger 64 operates to align all of the edges of the sheet set 130 prior to stapling by the stapling station 50. Once stapled, the gate 58 is retracted and the sheet set 130 moves into gripper 66 which is used to pull the sheet set 130 around and underneath the stapling station for deposition upon the elevator-type sheet set stacking system.

Figure 5:
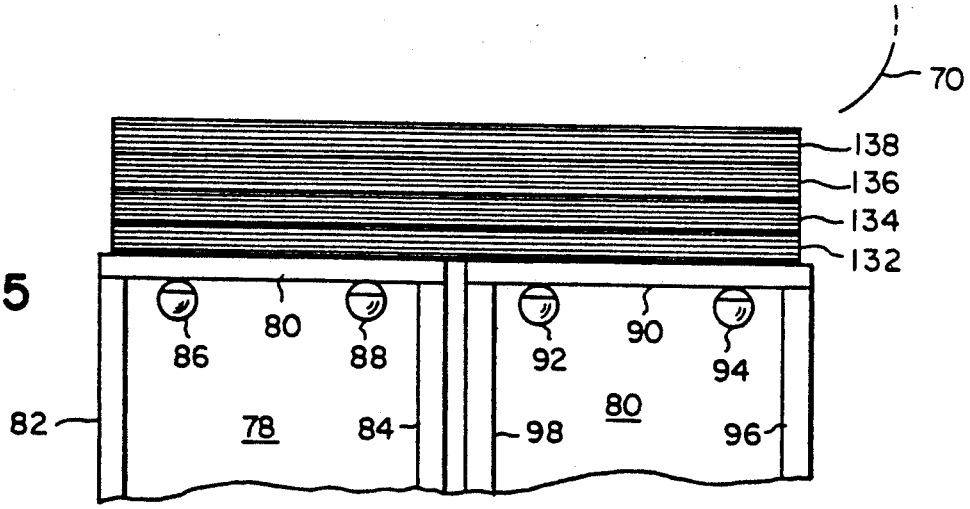
FIG. 5 is a schematic view of the stacking area of the finisher shown in FIG. 1 illustrating its operation with long paper.

FIG. 5 is a schematic view of the elevator-type sheet stacking system of the finisher 10 when used for stacking sheet sets composed of sheets of the larger size. According to FIG. 5, the sheet sets are deposited across both elevator system trays, that is, trays 80 and 90. The elevator systems operate simultaneously in moving downward as additional sheet sets are placed thereupon. Due to the original dimensions of the elevator systems 78 and 80 and their adjacent locations, the longer sheet sets substantially cover both elevator trays 80 and 90. As the sheet sets 132, 134, 136 and 138 are deposited upon the trays, the elevator systems simultaneously move downward in equal amounts to, in effect, make one complete elevator-tray system dimensioned sufficiently wide enough to handle the larger sheet sets. As with the smaller sheet sets, as shown in FIG. 3, the trays 80 and 90 may be removed from the elevator systems to transport the completed sheet sets to other locations. With this type of system, it would be necessary to stop the finisher or replace the filled trays with empty trays before the finisher could continue operation. In any event, the elevator systems are operated together when using long paper to provide the required support area for the longer sheet sets, as opposed to being operated independently when being required to support only the shorter sheet sets.

The gripper releasers 100 and 102 shown in FIG. 1 are used to release the completed sheet sets over the appropriate elevator assembly system by appropriately releasing the gripper 66. When using the shorter sheet sets, the gripper 102 can be automatically controlled to release the gripper depending upon whether the sheet set is to go to elevator system 78 or 80. If it is to go to elevator system 80, the gripper will be released by gripper releaser 102. If it is to be placed upon elevator system 78, the releaser 102 will be controlled to not release the gripper 66. In this case, the gripper 66 is released by the gripper releaser 100, which can be fixed in position to release the gripper 66 regardless of the control applied to the gripper releaser 102. In other words, releaser 100 would always release the gripper whether or not it contained a sheet set. Releaser 102 would only release the gripper 66 when it is desired to place the sheet set on elevator system 80. When using long paper, the releaser 102 would not ever be controlled to release the gripper 66, thereby allowing the manual releaser 100 to effectively place the completed sheet sets on both the elevator systems 78 and 80.

Figure 6:
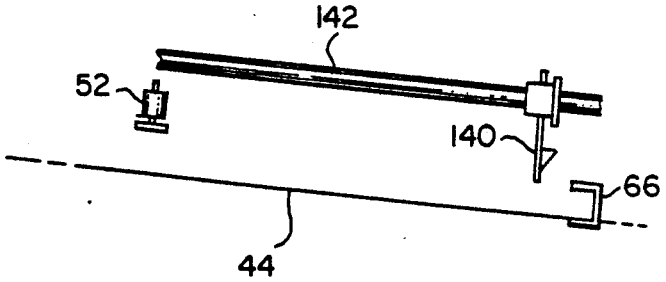
FIG. 6 is a partial view of a finisher having a single movable gate.

FIG. 6 shows another embodiment of the invention whereby the two fixed gates of the finisher are replaced with one movable and controllable gate. Gate 140 is movable along bar 142 so that it can be located near the gripper 66 on belt 44 or near the stapler 52. The gate 140 would be moved to the proper position depending on which size paper is being handled An automatic arrangement may be used, if desired, rather than moving or resetting the position of the gate 140 manually. Still another embodiment would be to have a controllable gate fixed at the stapler 52 and a movable and controllable gate at the gripper 66. Such an arrangement would permit setting the gate position for different standard paper sizes and controlling the gates to properly align standard sheets of different lengths.

The finisher accessory of this invention provides a unique and novel system for handling two very common paper sizes and binding requirements. Both size and staple locations are accommodated in the same apparatus with a minimum of duplicated components. Converting from one type of paper and stapling location to the other is a very simple matter and, in the case of shorter paper, completed sheet sets can be removed from the finisher while the finisher is still operating.

It is emphasized that numerous changes may be made in the above-described apparatus without departing from the teachings of the invention. It is intended that all of the matter contained in the foregoing description, or shown in the accompanying drawing, shall be interpreted as illustrative rather than limiting.

I claim as my invention:

1. A finisher accessory suitable for use with hard copy printers which produce printed sheets having first and second predetermined widths, said accessory being operable to fasten together a plurality of similar sized sheets to form a fastened sheet set, said accessory comprising:

a fastening station operable to fasten the sheet sets together with a fastening member;

means for transporting sheets into the fastening station;

a first controllable gate positioned along the transport means to locate the edges of sheets having the first predetermined width at the fastening station;

a second controllable gate positioned along the transport means to locate the centers of sheets having the second predetermined width at the fastening station;

means for removing fastened sheet sets from the fastening station; and means for controlling the position of the first and second gates depending upon the width of the sheets being fastened.

2. The finisher accessory of claim 1 wherein the apparatus also includes first and second means for stacking the bound sheet sets removed from the fastening station, said first and second stacking means being positioned adjacent to each other and dimensioned such that each stacking means can be used individually for stacking sheet sets having sheets of the first predetermined width and both stacking means can be used together for stacking sheet sets having sheets of the second predetermined width.

3. The finisher accessory of claim 2 wherein the first and second stacking means are elevator controlled supports which are individually movable vertically when the sheet sets include sheets of the first predetermined width, and which are synchronously movable together vertically when the sheet sets include sheets of the second predetermined width.

4. The finisher accessory of claim 1 wherein the first and second controllable gates are spaced apart a distance equal to the first predetermined width minus the distance between the edge of the sheet and the desired location for the fastening member on that edge of the sheet.

5. The finisher accessory of claim 4 wherein the first predetermined width is 8½ inches, the second predetermined width is 17 inches, the length of each sheet is 11 inches, and the gate spacing is between 8 1/16 and 8⅞ inches.

6. The finisher accessory of claim 1 wherein the fastening member comprises at least one wire staple.

7. The finisher accessory of claim 1 wherein the transport means includes a conveyor assembly which is movable relative to the gates and the fastening station, and a sheet feed and guide assembly for accepting sheets from the associated printer and sending the sheets into the fastening station.

8. The finisher accessory of claim 1 wherein the first gate is positioned along the transporting means at a location for stopping sheets of the first predetermined width such that the edges of the sheets are displaced from the center of the fastening station enough to permit the placement of the fastening member along that edge of the sheets.

9. The finisher accessory of claim 8 wherein the removing means is movable along a path which results in the sheet sets being turned over before being released by the gripper.

10. The finisher accessory of claim 1 wherein the second gate is positioned along the transporting means at a location for stopping sheets of the second predetermined width such that the centers of the sheets are aligned at the center of the fastening station to permit the placement of the fastening member at the center of the sheets.

11. The finisher accessory of claim 1 wherein the removing means includes a gripper movable by the transporting means to pull the fastened sheet sets from the fastening station.

12. The finisher accessory of claim 11 wherein the apparatus also includes first and second gripper releasing means, with said first releasing means being controllable to release the gripper only when sheet sets containing sheets of the first width are gripped.

13. The finisher accessory of claim 1 wherein the apparatus also includes a separate sheet feeder system which is controllable to interleave single sheets within the sheet sets.

14. The finisher accessory of claim 1 wherein the apparatus also includes means for ejecting the fastened sheet sets individually from the apparatus.

15. The finisher accessory of claim 1 wherein the gates, fastening station, and transporting means are positioned and sized to function with printed sheets having equal lengths and having the second predetermined width double that of the first predetermined width.

16. A finisher accessory suitable for use with hard copy printers which produce printed sheets having equal lengths and first and second predetermined widths, with the second predetermined width being double that of the first predetermined width, said accessory being operable to fasten together a plurality of similar sized sheets to form a fastened sheet set, said accessory apparatus comprising:

a stapling station operable to fasten together the sheet sets with a plurality of staples;

means for placing a plurality of the sheets into the stapling station to form a sheet set;

a first controllable gate positioned for stopping sheets of the first predetermined width such that the edges of the sheets are displaced from the center of the stapling station enough to permit the location of the staples along that edge of the sheets;

a second controllable gate positioned for stopping sheets of the second predetermined width such that the centers of the sheets are aligned with the center of the stapling station to permit the placement of the staples at the center of the sheets, said first and second gates being spaced apart a distance equal to the first predetermined width minus the distance between the edge of a sheet of the first predetermined width and the desired location for the staples along that edge of the sheet;

means for controlling the status of the first and second gates, with the first gate being controlled to stop sheets when the sheets to be stapled have the first predetermined idth and the second gate being controlled to stop sheets when the sheets to be stapled have the second predetermined width;

means for removing the stapled sheet sets from the stapling station; and first and second controlled elevator systems onto which the stapled sheet sets are positioned, said elevator systems being located adjacent to each other and controlled to vertically move separately when the sheet sets include sheets of the first predetermined width and to vertically move together when the sheet sets include sheets of the second predetermined width.

17. The finisher accessory of claim 16 wherein the first predetermined width is 8½ inches, the second predetermined width is 17 inches, the sheet length is 11 inches, and the gate spacing is between 8 1/16 and 8⅞ inches.

18. The finisher accessory of claim 16 wherein the placing means includes a conveyor assembly which is movable relative to the gates and the stapling station, and a sheet feed and guide assembly for accepting sheets from the associated printer and sending the sheets into the stapling station.

19. The finisher accessory of claim 18 wherein the conveyor assembly includes a gripper for pulling the fastened sheet sets from the stapling station, with said conveyor turning over the sheet sets before being released by the gripper.

20. The finisher accessory of claim 18 wherein the apparatus also includes:

means for interleaving single sheets within the sheet sets;

means for ejecting the stapled sheet sets individually from the apparatus; and noncontrollable means for releasing the gripper when positioned over at least one of the elevator systems.

21. A finisher accessory suitable for use with hard copy printers which produce printed sheets having first and second predetermined widths, said accessory being operable to fasten together a plurality of similar sized sheets to form a fastened sheet set, said accessory comprising:

a fastening station operable to fasten the sheet sets together with a fastening member;

means for transporting sheets into the fastening station;

a controllable gate movable to first and second locations, said first location being positioned along the transport means to locate the edges of sheets having the first predetermined width at the fastening station, and said second location being positioned along the transport means to locate the centers of sheets having the second predetermined width at the fastening station;

means for removing fastened sheet sets from the fastening station; and means for controlling the position and setting the location of the movable gate depending upon the width of the sheets being fastened.

22. The finisher accessory of claim 21 wherein the apparatus also includes first and second means for stacking the bound sheet sets removed from the fastening station, said first and second stacking means being positioned adjacent to each other and dimensioned such that each stacking means can be used individually for stacking sheet sets having sheets of the first predetermined width and both stacking means can be used together for stacking sheet sets having sheets of the second predetermined width.

23. The finisher accessory of claim 22 wherein the first and second stacking means are elevator controlled supports which are individually movable vertically when the sheet sets include sheets of the first predetermined width, and which are synchronously movable together vertically when the sheet sets include sheets of the second predetermined width.

24. The finisher accessory of claim 21 wherein the first and second locations of the movable gate are spaced apart a distance equal to the first predetermined width minus the distance between the edge of the sheet and the desired location for the fastening member on that edge of the sheet.

25. The finisher accessory of claim 21 wherein the first gate location is positioned along the transporting means at a location for stopping sheets of the first predetermined width such that the edges of the sheets are displaced from the center of the fastening station enough to permit the placement of the fastening member along that edge of the sheets.

26. The finisher accessory of claim 21 wherein the second gate location is positioned along the transporting means at a location for stopping sheets of the second predetermined width such that the centers of the sheets are aligned at the center of the fastening station to permit the placement of the fastening member at the center of the sheets.

27. The finisher accessory of claim 21 wherein the gates, fastening station, and transporting means are positioned and sized to function with printed sheets having equal lengths and having the second predetermined width double that of the first predetermined width.

* * * * *